US005162187A

United States Patent [19]

Lyons et al.

[11] Patent Number: 5,162,187

[45] Date of Patent: Nov. 10, 1992

[54] DEVELOPER COMPOSITIONS WITH COATED CARRIER PARTICLES

[75] Inventors: Christine C. Lyons, Webster; John A. Creatura, Ontario, both of N.Y.

[73] Assignee: Xerox Corporation, Stamford, Conn.

[21] Appl. No.: 572,207

[22] Filed: Aug. 24, 1990

[51] Int. Cl.[5] ..... G03G 9/10

[52] U.S. Cl. ..... 430/106.6; 430/108; 428/407; 523/206; 524/908

[58] Field of Search ..... 428/407; 430/108, 106.6; 523/206; 524/908

[56] References Cited

U.S. PATENT DOCUMENTS

| | | | |
|---|---|---|---|
| 3,929,657 | 12/1975 | Jones | 252/62.1 P |
| 4,125,667 | 11/1978 | Jones | 428/403 |
| 4,233,387 | 11/1980 | Mammino et al. | 430/137 |
| 4,485,162 | 11/1984 | Imamura et al. | 430/106.6 |
| 4,640,880 | 2/1987 | Kawanishi et al. | 430/106.6 |
| 4,935,326 | 6/1990 | Creatura et al. | 430/108 |
| 4,937,166 | 6/1990 | Creatura et al. | 430/108 |

*Primary Examiner*—Marion E. McCamish
*Assistant Examiner*—S. Rosasco
*Attorney, Agent, or Firm*—E. O. Palazzo

[57] ABSTRACT

A carrier composition comprised of a semiconductive ferrite core with a coating thereover comprised of a mixture of first and second polymers that are not in close proximity thereto in the triboelectric series.

5 Claims, No Drawings

DEVELOPER COMPOSITIONS WITH COATED CARRIER PARTICLES

BACKGROUND OF THE INVENTION

This invention is generally directed to developer compositions, and more specifically, the present invention relates to developer compositions with coated carrier particles. In one embodiment of the present invention, the carrier particles are comprised of a semiconductive or conductive core, such as a ferrite core, with coating thereover generated from a mixture of polymers that are not in close proximity thereto in the triboelectric series. In another aspect of the present invention, the carrier particles are prepared by a dry coating process wherein a mixture of certain polymers are applied to the carrier enabling relatively constant conductivity parameters; and also wherein the triboelectric charge on the carrier can vary, sometimes significantly, depending on the coatings selected. The developer compositions of the present invention can be selected for electrostatographic or electrophotographic imaging systems, especially xerographic imaging and printing processes. Developer compositions comprised of the coated semiconductive ferrite carrier particles illustrated herein are useful in imaging methods wherein relatively constant conductivity parameters may be desired. In the aforementioned imaging processes, the triboelectric charge on the carrier particles can be preselected in embodiments of the present invention depending, for example, on the polymer composition applied to the carrier core.

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative toner particles or conductive toner compositions are selected depending on the development systems used. Moreover, of value with respect to the aforementioned developer compositions is the appropriate triboelectric charging values associated therewith, as it is these values that can enable continued constant developed images of high quality and excellent resolution.

Carrier particles for use in the development of electrostatic latent images are described in many patents including, for example, U.S. Pat. No. 3,590,000. These carrier particles may be comprised of various cores, including steel, with a coating thereover of fluoropolymers, and terpolymers of styrene, methacrylate, and silane compounds. Several efforts have focused on the attainment of coatings for carrier particles for the purpose of improving development quality, and also to permit particles that can be recycled, and that do not adversely effect the imaging member in any substantial manner. Many of the present commercial coatings can deteriorate rapidly, especially when selected for a continuous xerographic process where the entire coating may separate from the carrier core in the form of chips or flakes, and fail upon impact or abrasive contact with machine parts and other carrier particles. These flakes or chips, which cannot generally be reclaimed from the developer mixture, can have an adverse effect on the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity. The aforementioned modification in triboelectric charging characteristics can result in developed images of lower quality, and with background deposits.

There is illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic resin particles. The resulting mixture can then be dry blended until the thermoplastic resin particles adhere to the carrier core by mechanical impaction and/or electrostatic attraction. Thereafter, the mixture can be heated to a temperature of from about 320° F. to about 650° F. for a period of 20 minutes to about 120 minutes enabling the thermoplastic resin particles to melt and fuse on the carrier core. While the developer and carrier particles prepared in accordance with the process of this patent, the disclosure of which is totally incorporated herein by reference, are suitable for their intended purposes, the conductivity values of the resulting particles may not be constant in all instances, for example when a change in carrier coating weight is accomplished to achieve a modification of the triboelectric charging characteristics; and further with regard to the '387 patent, in some situations carrier and developer mixtures with only specific triboelectric charging values can be generated when certain conductivity values or characteristics are contemplated. With the invention of the present application, the conductivity of the resulting carrier particles is substantially constant, and moreover the triboelectric values can be selected to vary significantly, for example, from less than −15 microcoulombs per gram to greater than −70 microcoulombs per gram depending on the polymer mixture selected for affecting the coating process.

Ferrite carrier cores are known, reference for example U.S. Pat. No. 4,485,162, the disclosure of which is totally incorporated herein by reference, which patent illustrates magnetic carrier powders comprising particles of a ferrite of the formula as recited, for example, in Claim 1, wherein x is greater than 53 molar percent, and wherein each carrier is capable of exhibiting a changeable resistance of from about $10^{14}$ ohms when 100 volts are applied, and the ferrites are free of a resin coating. Ferrite carriers are also disclosed in U.S. Pat. Nos. 2,846,333; 2,452,529; 3,929,657 and 4,125,667, the disclosures of each of these patents being totally incorporated herein by reference.

Other patents include U.S. Pat. No. 3,939,086, which teaches steel carrier beads with polyethylene coatings, see column 6; U.S. Pat. No. 4,264,697, which discloses dry coating and fusing processes; 3,533,835; 3,658,500; 3,798,167; 3,918,968; 3,922,382; 4,238,558; 4,310,611; 4,397,935 and 4,434,220.

With further reference to the prior art, carriers obtained by applying insulating resinous coatings to porous metallic carrier cores using solution coating techniques may be undesirable in some situations from a number of viewpoints. For example, the coating material can usually reside in the pores of the carrier cores, rather than at the surfaces thereof, and therefore may not be available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles can involve the processing of excessive quantities of solvents, and further usually these processes can result in low product yields. Also, solution coated carrier particles, when combined and mixed with finely divided toner particles, provide in some instances triboelectric charging values which may be too low for many uses. The powder coating process illustrated herein eliminates or minimizes these disadvantages, and further there results carriers that enable developer mixtures that are capable of generating high and useful triboelectric charging values with finely divided toner particles, and also wherein the carrier particles are of a substantially constant conductivity range, or wherein the conductivity may be preselected. Additionally, there can be achieved with the present invention, independent of one another, desirable triboelectric charging characteristics and conductivity values; that is, for example, the triboelectric charging parameter is not dependent or confined to the carrier coating weight as is believed to be the situation with the process of U.S. Pat. No. 4,233,387 wherein an increase in coating weight on the carrier particles may function to also permit an increase in the triboelectric charging characteristics. With the carrier compositions of the present invention, in embodiments thereof there can be formulated conductive developers with selected triboelectric charging characteristics and/or conductivity values in a number of different combinations.

Thus, for example, there can be formulated in accordance with the invention of the present application developers with conductivities of from about $10^{-5}$ mho (cm)$^{1}$ to about $10^{-17}$ mho (cm)$^{-1}$ as determined in a magnetic brush conducting cell, and triboelectric charging values of from about a $-8$ to about a $-80$ microcoulombs per gram on the carrier particles as determined by the known Faraday Cage technique. The developers of the present invention can be formulated with constant conductivity values and different triboelectric charging characteristics by, for example, maintaining the same coating weight on the carrier particles and changing the polymer coating ratios. Similarly, there can be formulated developer compositions wherein constant triboelectric charging values are achieved and the conductivities are altered by retaining the polymer ratio coating constant and modifying the coating weight for the carrier particles.

In U.S. Pat. Nos. 4,935,326 and 4,937,166, the disclosures of which are totally incorporated herein by reference, there are illustrated developers with carrier cores, including ferrites in general, which cores can be coated with a polymer mixture wherein the polymers are not in close proximity in the triboelectric series.

SUMMARY OF THE INVENTION

It is a feature of the present invention to provide toner and developer compositions with carrier particles containing a polymer mixture coating.

In another feature of the present invention there are provided carrier particles of substantially constant conductivity parameters.

In yet another feature of the present invention there are provided carrier particles of substantially constant conductivity parameters, and a wide range of preselected triboelectric charging values.

In yet another feature of the present invention there are provided dry coating processes for generating carrier particles of substantially constant conductivity parameters, and a broad range of preselected triboelectric charging values.

In yet a further feature of the present invention there are provided carrier particles comprised of a coating with a mixture of polymers that are not in close triboelectric proximity, that is for example a mixture of two polymers from different positions in the triboelectric series.

In still a further feature of the present invention there are provided carrier particles comprised of a semiconductive ferrite core with a coating thereover generated from a mixture of polymers.

In an additional feature of the present invention there are provided carrier particles comprised of a semiconductive ferrite core with a coating thereover generated from a mixture of polymers wherein the carrier triboelectric charging values can be from about $-10$ microcoulombs to about $-70$ microcoulombs per gram at the same coating weight.

In another feature of the present invention there are provided methods for the development of electrostatic latent images wherein the developer mixture selected comprises semiconductive ferrite carrier particles with a coating thereover comprised of a mixture of polymers that are not in close proximity in the triboelectric series.

Also, in another feature of the present invention there are provided positively charged toner compositions, or negatively charged toner compositions having incorporated therein carrier particles with a coating thereover of a mixture of certain polymers.

Another feature of the present invention resides in the provision of carrier components with ferrite cores containing a mixture of polymers not in close proximity in the triboelectric series, which polymers are insoluble in a number of solvents, and wherein the carrier conductivity and triboelectric charging values can be preselected.

These and other features of the present invention can be accomplished in embodiments thereof by providing developer compositions comprised of toner particles and carrier particles that can be prepared by a powder coating process, and wherein the carrier particles are comprised of a core with a coating thereover comprised of a mixture of polymers. More specifically, the carrier particles selected can be prepared by mixing low density porous magnetic or magnetically attractable semiconductive ferrite core carrier particles with from, for example, between about 0.05 percent and about 5 percent, and in embodiments 3 percent by weight, based on the weight of the coated carrier particles, of a mixture, especially of two polymers until adherence thereof to the carrier core by mechanical impaction or electrostatic attraction; heating the mixture of carrier core particles and polymers to a temperature, for example, of between from about 200° F. to about 550° F., for a period of from about 10 minutes to about 60 minutes enabling the polymers to melt and fuse to the carrier core particles; cooling the coated carrier particles; and thereafter classifying the obtained carrier particles to a desired particle size diameter.

In an embodiment of the present invention there are provided carrier particles comprised of a semiconductive ferrite core, such as a magnesium, copper zinc ferrite available from Steward Chemical Company with a conductivity of from about $10^{-8}$ to $10^{-10}$ mho/cm$^{-1}$ as determined, for example, at a 200 volt potential across a 0.1 inch gap in a device with the aforementioned core retained in position by a magnet with a coating thereover comprised of a mixture of a first dry polymer component and a second dry polymer component, which are not in close proximity in the triboelectric series. The aforementioned carrier compositions can be comprised of the core materials indicated with a dry polymer coating mixture thereover. Subsequently, developer compositions of the present invention can be generated by admixing the aforementioned carrier particles with a toner composition comprised of resin particles, pigment particles, and optional additive particles.

Various suitable semiconductive ferrite core carrier materials can be selected as indicated herein, such as copper zinc ferrites, magnesium copper zinc ferrites, ferrites obtained from fly ash, reference U.S. Pat. No. 4,894,305, the disclosure of which is totally incorporated herein by reference, magnetities, and the like. The ferrite carrier core in embodiments of the present invention may contain suitable effective amounts, for example up to about 0.5 percent, or less of nickel, manganese, zinc, copper, magnesium, and the like to, for example, provide for certain specific conductivities thereof. Specific examples of ferrites are comprised of manganese, magnesium, copper, zinc, nickel, iron, oxygen, and the like. One ferrite is comprised of manganese, copper, zinc, nickel, iron, and oxygen. Another ferrite is comprised of magnesium, copper, zinc, iron, and oxygen. In embodiments of the present invention, the ferrite selected can be comprised of from about 0.1 to about 20 weight percent of copper, from about zero to about 50 weight percent of magnesium, from about 2 to about 25 weight percent of zinc, from about zero to about 12 weight percent of nickel, from about zero to about 3 weight percent of manganese, from about 22 to about 35 weight percent of oxygen, and from about 40 to about 60 weight percent of iron, especially the ferric form thereof. One ferrite selected can be comprised of from about 6 to about 8, and preferably 7, weight percent of copper; from about 11 to about 13, and preferably 12 weight percent of zinc; from about 1 to about 3, and preferably 2, weight percent of magnesium; from about 48 to about 54, and preferably 51, weight percent of ferric iron; and from about 22 to about 34, and preferably 28, weight percent of oxygen.

Illustrative examples of polymer coatings selected for the carrier particles of the present invention include those that are not in close proximity in the triboelectric series, reference the copending applications mentioned herein. Specific examples of polymer mixtures used include polyvinylidenefluoride with polyethylene; polymethylmethacrylate and copolyethylene vinylacetate; copolyvinylidenefluoride tetrafluoroethylene and polyethylene; polymethyl methacrylate and copolyethylene vinylacetate; and polymethylmethacrylate and polyvinylidenefluoride. Other related polymer mixtures not specifically mentioned herein can be selected including, for example, polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate.

With further reference to the polymer coating mixture, close proximity in embodiments of the present invention indicates that the choice of the polymers selected is dictated by their position in the triboelectric series, therefore, for example, one may select a first polymer with a significantly lower triboelectric charging value than the second polymer. For example, the triboelectric charge of a semiconductive ferrite carrier core with a polyvinylidenefluoride coating is about −75 microcoulombs per gram. However, the same carrier, with the exception that there is selected a coating of polyethylene, has a triboelectric charging value of about −18 microcoulombs per gram. More specifically, not in close proximity refers, for example, to first and second polymers that are at different electronic work function values, that is they are not at the same electronic work function value; and further, the first and second polymers are comprised of different components. Additionally, the difference in electronic work functions between the first and second polymer is at least 0.2 electron volt, and preferably is about 2 electron volts; and moreover, it is known that the triboelectric series corresponds to the known electronic work function series for polymers, reference "Electrical Properties of Polymers", Seanor, D. A., Chapter 17, *Polymer Science*, A. D. Jenkins, Editor, North Holland Publishing (1972), the disclosure of which is totally incorporated herein by reference.

The percentage of each polymer present in the carrier coating mixture can vary depending, for example, on the specific components selected, the coating weight and the properties desired. Generally, the coated polymer mixtures used contain from about 10 to about 90 percent of the first polymer, and from about 90 to about 10 percent by weight of the second polymer. In an embodiment, there are selected mixtures of two polymers with from about 20 to about 80 percent by weight of the first polymer, and from about 50 to about 20 percent by weight of a second polymer. In one embodiment of the present invention, when a high triboelectric charging value is desired, that is exceeding −50 microcoulombs per gram, there is selected from about 90 percent by weight of the first polymer such as polyvinylidenefluoride, and 10 percent by weight of the second polymer such as polyethylene. In contrast, when a lower triboelectric charging value is desired, less than about −20 microcoulombs per gram, there can be selected from about 10 percent by weight of the first polymer, and 90 percent by weight of the second polymer; from about 60 percent by weight of the first polymer, and 40 percent by weight of the second polymer; from about 50 percent by weight of the first polymer, and 50 percent by weight of the second polymer; and the like.

There is selected in accordance with an embodiment of the present invention carrier particles of relatively constant conductivities at selected levels between from about $10^{-15}$ mho-cm$^{-1}$ to about $10^{-8}$ mho-cm$^{-1}$ at, for example, a 200 volt potential across a 0.1 inch gap containing the carrier as, for example, beads held in place by a magnet; and wherein the carrier particles are of a triboelectric charging value of from about −5 microcoulombs per gram to about −70 microcoulombs per gram, and in embodiments from about −5 microcoulombs per gram to about −25 microcoulombs per gram, these parameters being dependent on the coatings selected, and the percentage of each of the polymers used as indicated hereinbefore.

Various effective suitable means can be used to apply the polymer mixture coatings to the surface of the carrier particles. Examples of typical means for this purpose include combining the carrier core material and the mixture of polymers by cascade roll mixing or tumbling, milling, shaking, electrostatic powder cloud spraying, fluidized bed, electrostatic disc processing, and an electrostatic curtain. Following application of the polymer mixture, heating is initiated to permit flow-out of the coating material over the surface of the carrier core. The concentration of the coating material powder particles, as well as the parameters of the heating step, may be selected to enable the formation of a continuous film of the coating material on the surface of the carrier core, or permit only selected areas of the carrier core to be coated. When selected areas of the metal carrier core remain uncoated or exposed, the carrier particles will usually possess electrically conductive properties. The aforementioned conductivities can include various suitable values. Generally, however, this conductivity is from about $10^{-8}$ to about $10^{-17}$ mho-cm$^{-1}$ as measured, for example, across a 0.1 inch magnetic brush at an applied potential of 200 volts; and wherein the coating coverage encompasses from about 10 percent to about 100 percent of the carrier core. Coating weight can vary; generally from about 0.1 to about 10, or from about 0.1 to about 3 coating weight percent can be selected. Carrier particle diameter can vary as illustrated in the prior art, and generally the diameter is of a sufficient value to enable transport of the toner, which values can be, for example, about 1,000 microns or less in diameter in embodiments of the present invention.

Illustrative examples of finely divided toner resins selected for the developer compositions of the present invention include polyamides, epoxies, polyurethanes, diolefins, styrene acrylates, styrene methacrylates, styrene butadienes, vinyl resins and polymeric esterification products of a dicarboxylic acid and a diol comprising a diphenol. Specific vinyl monomers that can be used subsequent to polymerization are styrene, p-chlorostyrene vinyl naphthalene, unsaturated monoolefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether, vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; and the like. Also, there may be selected as toner resins styrene butadiene copolymers, including suspension polymerized and emulsion polymerized styrene butadienes with from about 70 to about 95 percent of styrene in embodiments of the present invention.

As one toner resin there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers, styrene/butadiene copolymers, crosslinked styrene acrylates, crosslinked styrene methacrylates, polyester resins obtained from the reaction of bisphenol A and propylene oxide, and branched polyester resins resulting from the reaction of dimethylterephthalate, 1,3-butanediol, 1,2-propanediol and pentaerythritol.

Generally, from about 1 part to about 15 parts by weight of toner particles are mixed in a suitable vessel with from about 100 to about 300 parts by weight of the carrier particles of the present invention to provide for developer compositions. Other mixtures can also be selected.

Typical well known suitable pigments or dyes can be selected as the colorant for the toner particles including, for example, carbon black, nigrosine dye, lamp black, iron oxides, magnetites, and mixtures thereof. The pigment, which is preferably carbon black, is usually present in a sufficient amount to render the toner composition highly colored. Thus, the pigment particles, especially carbon black, are present in amounts of from about 1 percent by weight to about 20 percent by weight, and in embodiments of from about 2 to about 15 weight percent based on the total weight of the toner composition, however, lesser or greater amounts of pigment particles can be selected.

When the pigment particles are comprised of magnetites, which are a mixture of iron oxides ($FeO.Fe_2O_3$) including those commercially available as Mapico Black, they can be present in the toner composition in an amount of from about 10 percent by weight to about 70 percent by weight, and preferably in an amount of from about 20 percent by weight to about 50 percent by weight.

The resin particles are present in a sufficient but effective amount, thus when 10 percent by weight of pigment or colorant, such as carbon black, is contained therein about 90 percent by weight of resin material is selected. Generally, however, the toner composition is comprised of from about 85 percent to about 97 percent by weight of toner resin particles, and from about 3 percent by weight to about 15 percent by weight of pigment particles, such as carbon black.

Encompassed within the scope of the present invention are colored toner compositions comprised of toner resin particles, carrier particles and as pigments or colorants, blue, red, green, brown, magenta, cyan and/or yellow particles, as well as mixtures thereof. More specifically, illustrative examples of magenta materials that may be selected as pigments include 1,9-dimethyl-substituted quinacridone and anthraquinone dye identified in the Color Index as CI 60720, CI Dispersed Red 15, a diazo dye identified in the Color Index as CI 26050, CI Solvent Red 19, and the like. Examples of cyan materials that may be used as pigments include copper tetra-4(octaecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy aceto-acetanilide, permanent yellow FGL, and the like. These pigments are generally present in the toner composition an amount of from about 1 weight percent to about 15 weight percent, and in embodiments from about 2 to about 10 weight percent based on the weight of the toner resin particles.

For the primary purpose of enhancing the positive charging characteristics of the toner compositions described herein and as optional components, there can be incorporated therein or thereon charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; the charge additives of copending applications U.S. Ser. No. 396,497 (D/89261), U.S. Ser. No. 547,001 (D/90075), U.S. Pat. No. 4,904,762 and U.S. Pat. No. 4,937,157, the disclosures of which are totally incorporated herein by reference; and other known charge enhancing additives. These additives are usually present in an amount of from about 0.1 percent by weight to about 20 percent by weight, and in embodiments from about 1 to about 5 weight percent.

The toner compositions of the present invention can be prepared by a number of known methods including melt blending in a Banbury mill, for example, toner resin particles, pigment particles or colorants, and additives, followed by mechanical attrition. Other methods include those well known in the art such as spray drying, melt dispersion, dispersion polymerization, extrusion, and suspension polymerization. In one dispersion polymerization method, a solvent dispersion of the resin particles and the pigment particles is spray dried under controlled conditions to result in the desired product. It is known that the toners can be attrited and micronized, which micronization may include classification to provide toner particles with an average diameter of from about 10 to about 20 microns as determined by, for example, a Coulter Counter. There can be added to the toner product surface additives in effective amounts of, for example, from about 0.1 to about 3 weight percent, examples of which include metal salts of fatty acids, such as zinc stearate, colloidal silicas, and the like. The triboelectric charge on the toner as determined by the known Faraday Cage method can vary depending, for example, on the toner components, the carrier selected, and the like; generally, however, the triboelectric charge can be from about 10 to about 45 microcoulombs per gram.

The toner and developer compositions of the present invention may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants, such as halogens. Furthermore, there may be selected organic photoreceptors, illustrative examples of which include layered photoresponsive devices comprised of transport layers and photogenerating layers, reference U.S. Pat. Nos. 4,265,990; 4,921,773 and 4,464,450, the disclosures of which are totally incorporated herein by reference, and other similar layered photoresponsive devices. Examples of generating layers are trigonal selenium, metal phthalocyanines, metal free phthalocyanines, and vanadyl phthalocyanines. As charge transport molecules there can be selected, for example, the amines and the like disclosed in the '990 and the '773 patents. Also, there can be selected as photogenerating pigments squaraine compounds, thiapyrillium materials, and the like. These layered members are conventionally charged negatively, thus a positively charging toner is selected unless discharge area background development is conducted. The developer compositions of the present invention are particularly useful in electrostographic imaging processes and apparatuses wherein there is selected a moving transporting means and a moving charging means; and wherein there can be selected a deflected flexible layered imaging member, reference U.S. Pat. Nos. 4,394,429 and 4,368,970, the disclosures of which are totally incorporated herein by reference.

Images obtained with the developer compositions of the present invention can possess acceptable solids, excellent halftones and desirable line resolution with acceptable or substantially no background deposits, and excellent color intensity for full color xerographic imaging processes in embodiments thereof.

With further reference to the process for generating the carrier particles illustrated herein, there is initially obtained, usually from commercial sources, the uncoated ferrite carrier core and the polymer powder mixture coating. The individual components for the coating are available, for example, from Pennwalt as 301F Kynar, M116-polymethyl methyl methacrylate available from Sokem Chemical, and the like. Generally, these polymers are blended in various proportions as mentioned hereinbefore as, for example, in a ratio of 1:1, 0.1 to 0.9; and 0.5 to 0.5. The blending can be accomplished by numerous known methods including, for example, a twin sheel mixing apparatus. Thereafter, the carrier core polymer blend is incorporated into a mixing apparatus, about 0.3 percent by weight of the powder to the core by weight in an embodiment, and mixing is affected for a sufficient period of time until the polymer blend is uniformly distributed over the carrier core, and mechanically or electrostatically attached thereto. Subsequently, the resulting coated carrier particles are metered into a rotating tube furnace, which is maintained at a sufficient temperature to cause melting and fusing of the polymer blend to the carrier core.

Also, there can be obtained in accordance with the present invention carrier particles with positive triboelectric charging values thereon of from about 10 to about 80 microcoulombs per gram.

For the preparation of the toner compositions, various known methods may be selected as indicated herein, including melt blending in a Banbury, extrusion, and the like, followed by micronization. Micronization can include classification wherein there results toner compositions wherein most of the particles have a diameter of from about 10 to about 25 microns in average particle diameter.

The following Examples are being supplied to further define the present invention, it being noted that these Examples are intended to illustrate and not limit the scope of the present invention. Parts and percentages are by weight unless otherwise indicated.

EXAMPLE I

There were prepared carrier particles by coating 55,280 grams of a semiconductive ferrite core, 50 microns in diameter, which core was obtained from D. M Steward Chemical Company and is believed to contain about 2 weight percent of magnesium, about 7 weight percent of copper, about 12 weight percent of zinc, 50 weight percent of iron and 29 weight percent of oxygen with 170 grams of a blend of polymers comprised of 35 weight percent of polyvinylidene fluoride, available as Kynar 301F from Pennwalt Chemical, and 65 weight percent of polymethyl methacrylate M116 (0.3 percent total coating weight), by mixing these components for 60 minutes in a Munson MX-1 Minimixer rotating at 27.5 RPM. There resulted uniformly distributed and electrostatically attached, as determined by visual observation, on the carrier core the polyvinylidene fluoride/polymethyl methacrylate. Thereafter, the resulting carrier particles were metered into a rotating tube furnace at a rate of 105 grams/minute. This furnace was maintained at a temperature of 400° F. thereby causing the polymers to melt and fuse to the core. The conductivity of the resulting coated carrier product was $3.7\times10^{-11}$ mho $(cm)^{-1}$ as determined in a magnetic brush conducting cell.

A developer composition was then prepared by mixing 92.5 grams of the above prepared carrier particles with 7.5 grams of a toner composition comprised of 97 percent by weight of a styrene butadiene copolymer resin (89/11), 2 weight percent of the pigment PV Fast Blue, and 1 weight percent of the charge additive distearyl dimethyl ammonium methyl sulfate, which toner contained on the surface 0.4 weight percent of Aerosil R972 TM, 0.8 weight percent of stanous oxide, and 0.35 weight percent of Unilin TM 425, a polymeric alcohol available from Petrolite Corporation, reference U.S. Pat. No. 4,883,736, the disclosure of which is totally incorporated herein by reference. The toner was subjected to micronization enabling toner particles with an average diameter of about 11 microns. Thereafter, the triboelectric charge on the carrier particles was determined by the known Faraday Cage process, and there was measured on the carrier a charge of −9.5 microcoulombs per gram. The conductivity of the carrier as determined by forming a 0.1 inch long magnetic brush of the carrier particles, and measuring the conductivity by imposing a 200 volt potential across the above mentioned magnetic brush was $3.7\times10^{-11}$ mho (cm)—1.

In all the working Examples, the triboelectric charging values and the conductivities were obtained in accordance with the aforementioned procedure.

EXAMPLE II

The procedure of Example I was repeated with the exception that the polymer coating percentages were 40/60, respectively. The carrier particles had a conductivity of $3.1\times10^{-11}$ mho-$cm^{-11}$, and a triboelectric charge of −11.2 microcoulombs per gram.

EXAMPLE III

The procedure of Example I was repeated with the exception that the polymer coating percentages were 45/55, respectively. The carrier particles had a conductivity of $2.7\times10^{-11}$ mho-$cm^{-1}$, and a triboelectric charge of −14.0 microcoulombs per gram.

EXAMPLE IV

The procedure of Example I was repeated with the exception that the polymer coating percentages were 50/50, respectively. The carrier particles had a conductivity of $2.3\times10^{-11}$mho-$cm^{-1}$, and a triboelectric charge of −15.0 microcoulombs per gram.

EXAMPLE V

The procedure of Example I was repeated with the exception that the polymer coating percentages were 60/40, respectively. The carrier particles had a conductivity of $2.7\times10^{-11}$ mho-$cm^{-1}$, and a triboelectric charge of −18.7 microcoulombs per gram.

EXAMPLE VI

The procedure of Example I was repeated with the exception that the polymer coating percentages were 70/30, respectively. The carrier particles had a conductivity of $2.7\times10^{-11}$ mho-$cm^{-1}$, and a triboelectric charge of −20.5 microcoulombs per gram.

EXAMPLE VII

A toner and developer were prepared by repeating the procedure of Example I wherein the coating weight was 0.55 weight percent, and the polymer ratio was 70/30, respectively. The carrier particles had a conductivity of $5.0\times10^{-12}$ mho-$cm^{-1}$, and a triboelectric charge of −21.4 microcoulombs per gram.

EXAMPLE VIII

A toner and developer were prepared by repeating the procedure of Example I wherein the coating weight was 0.65 weight percent. The carrier particles had a conductivity of $1.3\times10^{-12}$ mho-$cm^{-1}$, and a triboelectric charge of −21.0 microcoulombs per gram.

EXAMPLE IX

A toner and developer were prepared by repeating the procedure of Example I wherein the ferrite core, 90 microns in diameter, was comprised of about 8 percent of nickel, 1.0 percent of copper, 17 percent of zinc, 1 percent of manganese, 45 percent of iron as ferric and 28 percent of oxygen, which core was obtained from Powder Technology Inc. About 59,530 grams of carrier core were selected for the preparation; the coating weight was 0.3 weight percent; and 180 grams of the polymer blend 25/75 ratio of Kynar and polymethyl acrylate was selected. The carrier particles had a conductivity of $6.2\times10^{-11}$ mho-$cm^{-1}$, and a triboelectric charge of −22.4 microcoulombs per gram.

EXAMPLE X

A toner and developer were prepared by repeating the procedure of Example IX wherein the polymer blend ratio of Kynar and polymethyl acrylate was 15/85. The carrier particles had a conductivity of $7.4\times10^{-11}$ mho-$cm^{-1}$, and a triboelectric charge of −7.1 microcoulombs per gram.

EXAMPLE XI

A toner and developer were prepared by repeating the procedure of Example I with the exceptions that the toner was comprised of 11 microns of toner with 97 percent of styrene butadiene (89/11), 2 percent of the yellow pigment Novaperm Yellow, and 1 weight percent of the charge additive distearyl dimethyl ammonium methyl sulfate. The carrier particles had a conductivity of $3.2\times10^{-11}$ mho-$cm^{-1}$, and a triboelectric charge of −9 microcoulombs per gram with a carrier coating (30/70) of Kynar and polymethacrylate at 0.3 weight percent coating weight. The ferrite carrier core was 50 microns in average diameter and was obtained from Steward Chemical Company, reference Example I.

EXAMPLE XII

A toner and developer were prepared by repeating the procedure of Example XI with the exception that the Kynar and polymethacrylate, ratio was 30/70. The carrier particles had a conductivity of $5.0\times10^{-11}$ mho-cm$^{-1}$, and a triboelectric charge of $-8.3$ microcoulombs per gram with a carrier coating (30/70) of Kynar and polymethacrylate, at 0.3 weight percent coating weight. The ferrite carrier core was 50 microns in average diameter and was obtained from Steward Chemical Company.

Also, a toner and developer was prepared by repeating the procedure of Example I wherein in the place of the PV Fast Blue there was selected 5 weight percent of the magenta pigment Hostaperm Pink, and 94 weight percent of styrene butadiene resin particles, and there resulted a carrier triboelectic charge of $-8.3$.microcoulombs per gram and carrier conductivity of $5.0\times10^{-11}$ mho-cm$^{-1}$.

With further reference to the above Examples, the conductivity values were obtained as indicated herein. Specifically, these values were generated by the formation of a magnetic brush with the prepared carrier particles. The brush was present within a one electrode cell with a magnet as one electrode and a nonmagnetic steel surface as the opposite electrode. A gap of 0.100 inch was maintained between the two electrodes and a 200 volt bias was applied in this gap. The resulting current through the brush was recorded and the conductivity is calculated based on the measured current and geometry.

More specifically, the conductivity in mho-cm$^{-1}$ is the product of the current, and the thickness of the brush, about 0.254 centimeter divided by the product of the applied voltage, and the effective electrode area.

With respect to the triboelectric numbers in microcoulombs per gram, they were determined by placing the developer materials in an 8 ounce glass jar with 7.5 percent by weight of toner compositions, placed on a Red Devil Paint Shaker and agitated for 10 minutes. Subsequently, the jar was removed and samples from the jar were placed in a known tribo Faraday Cage apparatus. The blow off tribo of the carrier particles was then measured.

The developer of Example I was incorporated into a Xerox Corporation imaging test fixture with a photoreceptor imaging member comprised of aluminum, a photogenerating layer of trigonal selenium dispersed in polyvinyl carbazole thereover, and a charge transport layer of N,N'-diphenyl-N,N'-bis(3-methylphenyl)[1,1-biphenyl]-4,4'-diamine, 50 percent by weight dispersed in 50 percent by weight of polycarbonate. A plotted line graph indicated that the triboelectric charge, and by inference the carrier coating ratio, and coating weight amount present remained relatively constant, that is about $-12$ microcoulombs per gram for slightly more than 50,000 imaging cycles, with a 40 to 60 polymer ratio and a 0.3 weight percent coating weight.

With conductive developers there can be achieved, for example, developed images, especially xerographic images, with enhanced solid areas.

Other modifications of the present invention may occur to those skilled in the art based upon a reading of the present disclosure and these modifications are intended to be included within the scope of the present invention.

What is claimed is:

1. A carrier composition consisting essentially of a semiconductive ferrite core with a coating thereover consisting essentially of a mixture of first and second polymers that are not in close proximity thereto in the triboelectric series, wherein the triboelectric charging properties of the carrier are independent of the conductivities thereof, said triboelectricl properties being dependent on the ratio of polymers present, and said conductivities being dependent on the coating weight of the polymers selected; and wherein the semiconductive ferrite core has a conductivity of from about $10^{-5}$ to about $10^{-12}$ mho-cm$^{-1}$.

2. A carrier in accordance with claim 1 wherein the semiconductive ferrite core carrier core is comprised of from about 0.1 to about 20 weight percent of copper; from about zero to about 50 weight percent of magnesium; from about 2 to about 25 weight percent of zinc; from about zero to about 12 weight percent of nickel; from about zero to about 3 weight percent of manganese; from about 22 to about 35 weight percent of oxygen; and from about 40 to about 60 weight percent of ferric iron.

3. A carrier composition in accordance with claim 1 wherein the semiconductive ferrite core carrier core is comprised of from about 6 to about 8 weight percent of copper; from about 11 to about 13 weight percent of zinc; from about 1 to about 3 weight percent of magnesium; from about 48 to about 54 weight percent of ferric iron; and from about 22 to about 34 weight percent of oxygen.

4. A carrier composition in accordance with claim 1 wherein the carrier core coating is comprised of first and second polymers selected from the group consisting of polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate.

5. A developer composition comprised of the carrier of claim 1 and toner.

* * * * *